United States Patent [19]

Malfit

[11] Patent Number: 5,028,221

[45] Date of Patent: Jul. 2, 1991

[54] HIGH PRESSURE HYDRAULIC GENERATOR RECEIVER FOR POWER TRANSMISSION

[76] Inventor: Jean Malfit, 2, avenue de Chapotte, Tournon (Ardeche), France, 07300

[21] Appl. No.: 529,738

[22] Filed: May 14, 1990

Related U.S. Application Data

[63] Continuation of Ser. No. 133,811, filed as PCT FR87/00103 on Apr. 1, 1987, published as WO87/05975 on Oct. 8, 1987, now abandoned.

[30] Foreign Application Priority Data

Apr. 4, 1986 [FR] France ..... 86 05152
Oct. 22, 1986 [FR] France ..... 86 15016

[51] Int. Cl.[5] ..... F03C 2/08; F04C 2/16; F04C 5/00; F04C 15/00

[52] U.S. Cl. ..... 418/72; 418/77; 418/132; 418/152; 418/201.3

[58] Field of Search ..... 418/72, 74, 77, 132, 418/152, 156, 201 R, 201 A, 201 B

[56] References Cited

U.S. PATENT DOCUMENTS

| | | | |
|---|---|---|---|
| 557,123 | 3/1896 | Hall | 418/72 |
| 2,029,742 | 2/1936 | Sieverts | 418/72 |
| 2,188,702 | 1/1940 | Burghauser | 418/72 |
| 2,338,065 | 12/1943 | Ungar | 418/74 |
| 2,491,365 | 12/1949 | Ernst | 418/72 |
| 2,541,010 | 2/1951 | Ungar | 418/74 |
| 3,051,091 | 8/1962 | Bennett et al. | 418/132 |
| 3,291,061 | 12/1966 | Shinohara | 418/74 |

FOREIGN PATENT DOCUMENTS

| | | | |
|---|---|---|---|
| 795534 | 1/1936 | France | 418/72 |
| 57-20580 | 2/1982 | Japan | 418/156 |

*Primary Examiner*—John J. Vrablik
*Attorney, Agent, or Firm*—Pollock, Vande Sande & Priddy

[57] ABSTRACT

Hydraulic generator-receiver with needle bearings (123) on the driving gear (9) and providing for play compensation between the end plates (21, 22) and the envelope (36), a leak return and a better supply of the pressure zone (34).

5 Claims, 11 Drawing Sheets

HIGH PRESSURE HYDRAULIC GENERATOR RECEIVER FOR POWER TRANSMISSION

This application is a continuation of application Ser. No. 133,811, filed as PCT FR87/00103 on Apr. 1, 1987, published as WO87/05975 on Oct. 8, 1987, abandoned.

FIELD OF THE INVENTION

This invention covers improvements to the hydraulic generator/receiver disclosed in applicant's U.S. Pat. No. 4,781,552, dated Nov. 1, 1988, which is herein incorporated by reference.

BACKGROUND OF THE INVENTION

The invention of the aforementioned patent has the following drawbacks:

(1) The machining of the drillings through the gears is complicated;

(2) The hydraulic bearings provided between the gears and the plates are not symmetrical;

(3) The decompression into the zone of maximum permanent total pressure is too slow during pressure drop of the delivery or reception pressure of the apparatus.

SUMMARY OF THE INVENTION

The object of the invention is the specific improvement of one of the different types of "hydraulic windings," which leads to a more equilibrated design in the conception of the hydraulic bearings between the faces of the gears and the faces of the plates, and also to easier construction and industrialization.

The description and reference numerals used in said patent are maintained, as well as the basic design of the hydraulic generator/receiver with helical gears disclosed therein.

A first object of the invention is to provide an easily machined "hydraulic winding";

A further object of the invention is to provide alternate ways of building the generator-receptor;

Another object of the invention is to provide a leakage return device in each rotating direction of the apparatus (generator or receptor);

A still further object of the invention is to provide better feeding of the zone of maximum permanent pressure of the hydraulic bearings and of the connection between the hydrostatic compensation sectors without drop of pressure into said zone.

The basic design of the hydraulic generator/receiver with helical gears according to the prior invention is characterized in that:

Each of the gears 9 and 10 has the same number of teeth, the same toothing, the same helix angle so that tg $\alpha = 2H/\pi Mt$, where Mt = apparent diametral pitch 5, H = tooth width 4, resulting in an offset of a half pitch between the tooth profiles along the faces;

The balancing of the gears 9 and 10 is provided by a system of "hydraulic windings" that makes the use of conventional bearings unnecessary and allows for the formation of hydraulic bearings that ensure a playless meshing of the gears 9 and 10;

The internal tightness is ensured by a system of plates 21 and 22 and an envelope 36 with a hydrostatic component on the faces and on the heads of the teeth of the gears 9 and 10, allowing play compensation in both directions.

These conditions ensure a constant flow Q, no longer pulsating as before, as well as a velocity vector of the flow which is parallel to the axis of the gears 9 and 10 for both modes, i.e., generator or receiver, the velocity components resulting from both the rotation and the helix angle neutralizing each other.

Applicant's U.S. Pat. No. 4,781,552 describes sector by sector balancing (see column 9, line 40 to column 10, line 2, and column 12, lines 42 to 52, as well as FIGS. 9 and 10 of the patent).

The invention utilizes the principle of sector-by-sector balancing, which consists in dividing the gear circumference reduced by the required value for the zone 34 at points 6 and 3, e.g., one angular pitch at 6 and zero angular pitch at 3, or one angular pitch at 6 and one at 3, to obtain an even number 2N of equal sectors, opposed to $\pi$ if the number of teeth Z is even, or $\pi +/-$ a half angular tooth pitch if the number of teeth Z is odd, these equal and opposed sectors being at the same pressure potential and in the same angular position on the plates 21 and 22 and on the envelope 36.

Opposed sectors are equal, but two consecutive sectors can be unequal.

The rotor channels have the shape 76 as defined in FIGS. 18 and 19 of U.S. Pat. No. 4,781,552, but with one extra characteristic, i.e. the rotor circuit is composed of diametric drillings 101 through the gears 9 and 10, drillings which come out into two channels 102 parallel to the axis of the gears (or at an angle equal to the helix angle $\alpha$) and opposite $\pi$ (channels 101 and 102 corresponding altogether to rotor conduits 19 of U.S. Pat. No. 4,781,552 in circuit shape 76) these two channels 102 feeding four symmetric commutation points on the commutation circle 20, these points feeding lubrication points between the faces of the plates 21 and 22 and the faces of the gears 9 and 10 in a symmetrical manner. This symmetry in the formation of the lubrication points can only be achieved if the stator and rotor channels have a 76-type shape.

The whole of the unit, drillings, rotor channels 101, 102 and stator channels 23, is designed so that:

There is a permanent connection between equipotential sectors;

The grooves of the teeth pass over from one sector at a given value of pressure to the following one at another given value of pressure without any risk of short-circuit that would cause leaks between sectors;

The grooves of the teeth opposite $\pi$ or $\pi +/-$ a half angular tooth pitch are at the same pressure potential, except at the pass-over points between sectors and at those points where the hydraulic bearings form themselves;

Consequently, the gears 9 and 10 are:

in equilibrium when the number of teeth Z is even, in equilibrium with an advantage on the side opposite that of the high pressure orifices 40 when the number of teeth Z is odd, advantage corresponding to a half tooth pitch under pressure;

There is total symmetry;

The relation between the grooves of opposed teeth is completely broken at the points 6 and 3, in order to provide for hydrostatic equilibrium at the points 6 where hydraulic bearings form themselves.

BRIEF DESCRIPTION OF THE DRAWINGS

In order that the invention may be more clearly understood, a description will now be given with reference to the accompanying drawings, wherein several embodiments of the invention are shown for purposes of illustration, and wherein.

DESCRIPTION OF PREFERRED EMBODIMENT

According to the invention, the rotor channels are constituted (a) by means of groups of channels 102 (FIG. 1) diametrically opposed around the commutation circle 20 and parallel (or at an angle equal to the helix angle $\alpha$) to the axis of the gears 9, 10 and (b) a multiplicity of channels 101 which connect the diametrically opposed channels 102.

Figure 1:
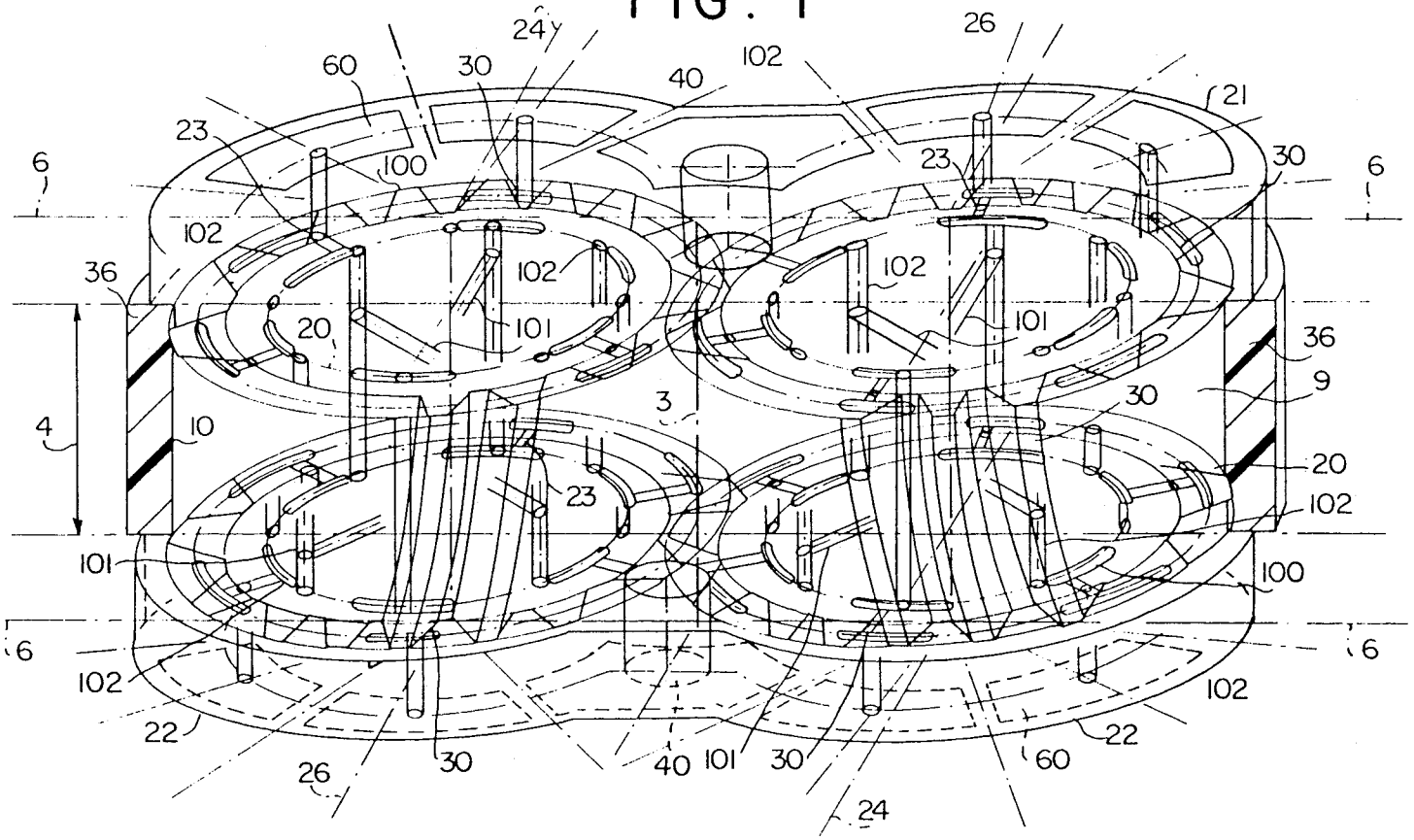
FIG. 1 is a perspective view of the unit according to the invention.

FIG. 1 is a perspective view of the unit according to the invention. The number of teeth Z is odd=15, the elastic 2N sectors engage at point 6. The helical gears 9 and 10 engage at point 3, rotate inside the plastic casing 36 and are inserted between plates 21 and 22. Play compensation between the gears 9 and 10 and the plates 21 and 22, is achieved by the 2N hydrostatic compensation sectors 60 on plates 21 and 22 and is made possible by the axial compressibility of casing 36.

The gears 9 and 10 are equilibrated by the stator channels consisting of the cavities 30 on the primitive circle, the channels 23, the cavities 100 (corresponding to grooves 41 of U.S. Pat. No. 4,781,552, FIGS. 9 and 10) of the commutation circle 20 and of the rotor channels made up of the channels 102 parallel to the gear axis (or at an angle $\alpha$ equal to the helix angle) and opposed to $\pi$, and of the channels 101 ensuring the diametral connection between the channels 102, the assembly ensuring an equipotential connection between the sectors opposite $\pi$ if Z is even and opposite $\pi+/-$ a half angular tooth pitch if Z is odd. The number of connections D is larger than N, in order to ensure a permanent connection between opposed sectors as well as sufficient tightness between sectors, by the overlapping of the channels 102 and the cavities 100. This permanent connection is broken at points 6 and 3 of the zone 34 of permanent total pressure, so that hydraulic bearings can form at the points 6.

FIG. 1 also shows the locations of the HP-LP cylinder-shape orifices 40, represented parallel to the gear axes. They may also have a different shape derived from that of the generated or incoming stream flow, and may also be at an angle equal to the helix angle.

Figure 2:
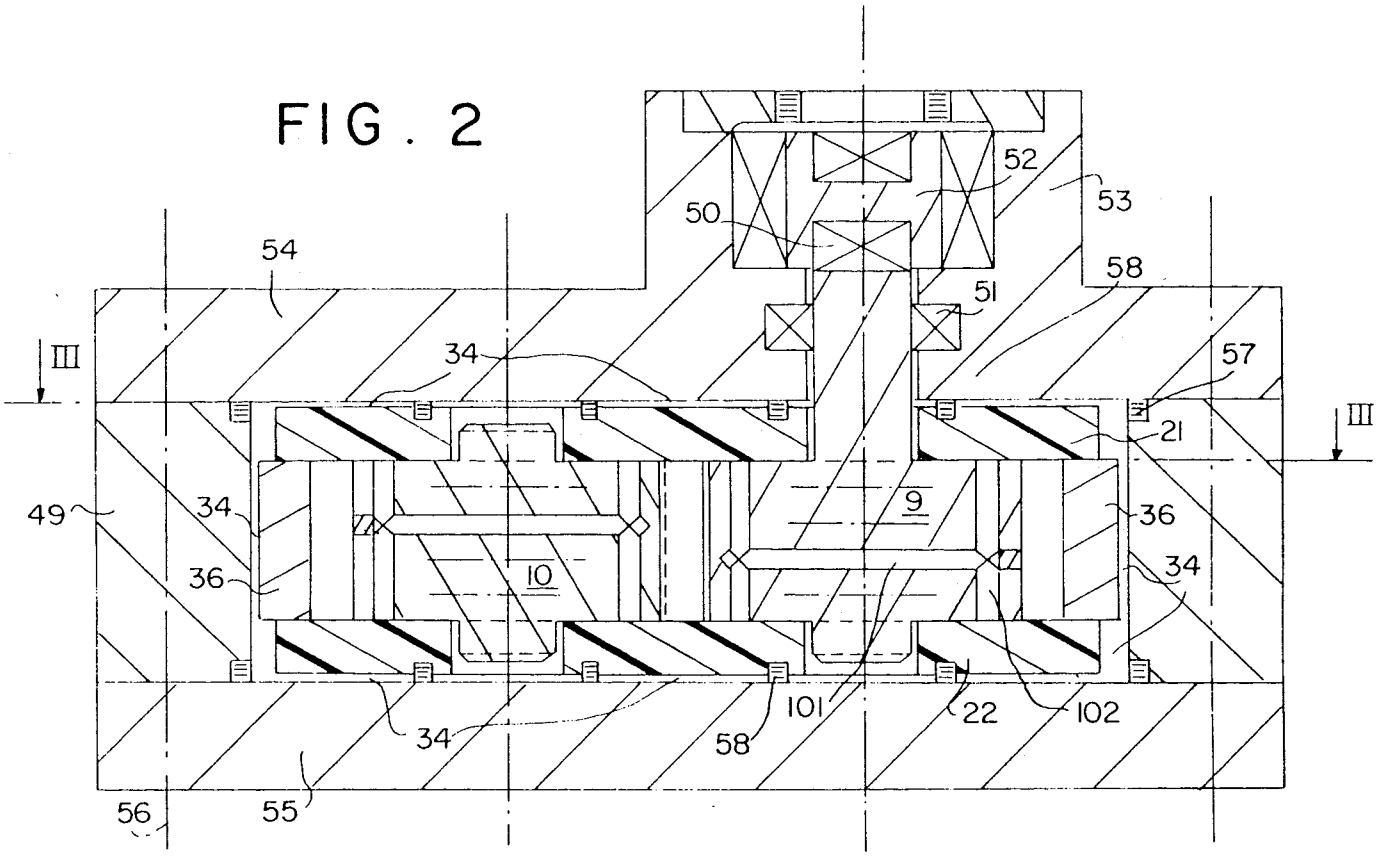
FIG. 2 is a cross section elevation view along line II—II (FIGS. 3 and 4)

FIG. 2 is a cross section elevation view along line II—II (FIGS. 3 and 4) as in the above case of play compensation by compression of the casing 36. It shows the zone 34 and the layout of the channels 101 and 102 in the gears 9 and 10.

Figure 3:
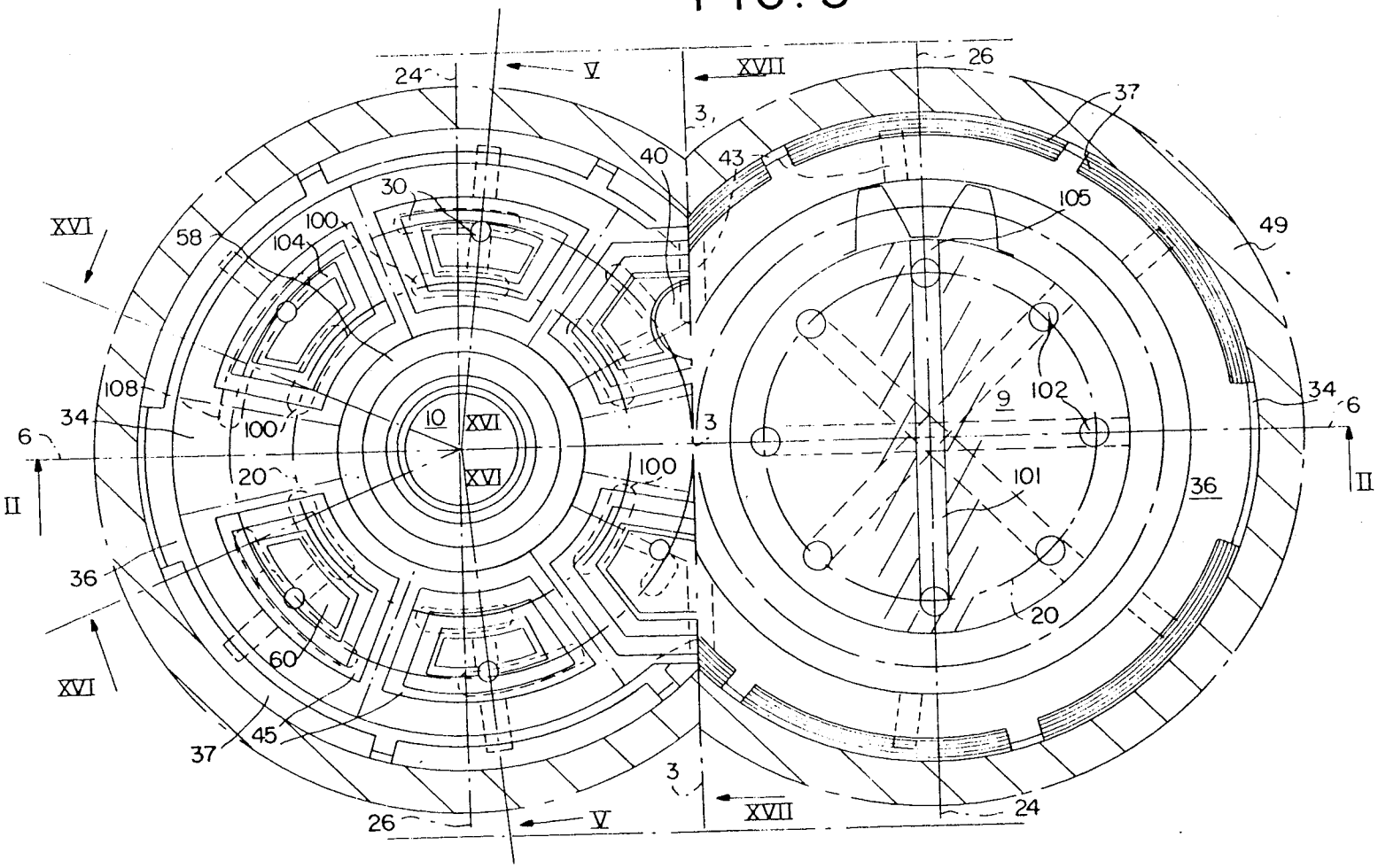
FIG. 3 is a cross section along line III—III (FIG. 2)

FIG. 3, which shows a partial cross-sections along the line III—III (FIGS. 2 and 20), illustrates the layout of the hydrostatic compensation sectors 60 on the plates 21 and 22 in the case of symmetrical construction with respect to the central plane perpendicular to the axes of the gears 9 and 10. This layout does not exactly correspond to the pressures to be equilibrated in so far as it does not take into account the offset introduced by the helix angle, i.e., a half angular pitch $\pi/Z$. The hydrostatic compensation sectors are materialized by the points 45, the anti-extrusion devices 104, and are equilibrated at $\pi$ or at $\pi+/-\pi/Z$ by the cavities 30, the channels 23, the stator cavities 100 and the rotor channels 101 and 102. This figure shows a possibility of balancing by means of channel 103, consisting of drillings either through the body 49, or through the covers 54 and 55, or by means of steel pipes external to the unit and connecting two sectors opposite $\pi$ or $\pi+/-\pi/Z$. It also shows an example of channels 101 obtained by drilling the channel from the groove of a tooth subsequently closed off by a brazed plug 105.

Figure 4:
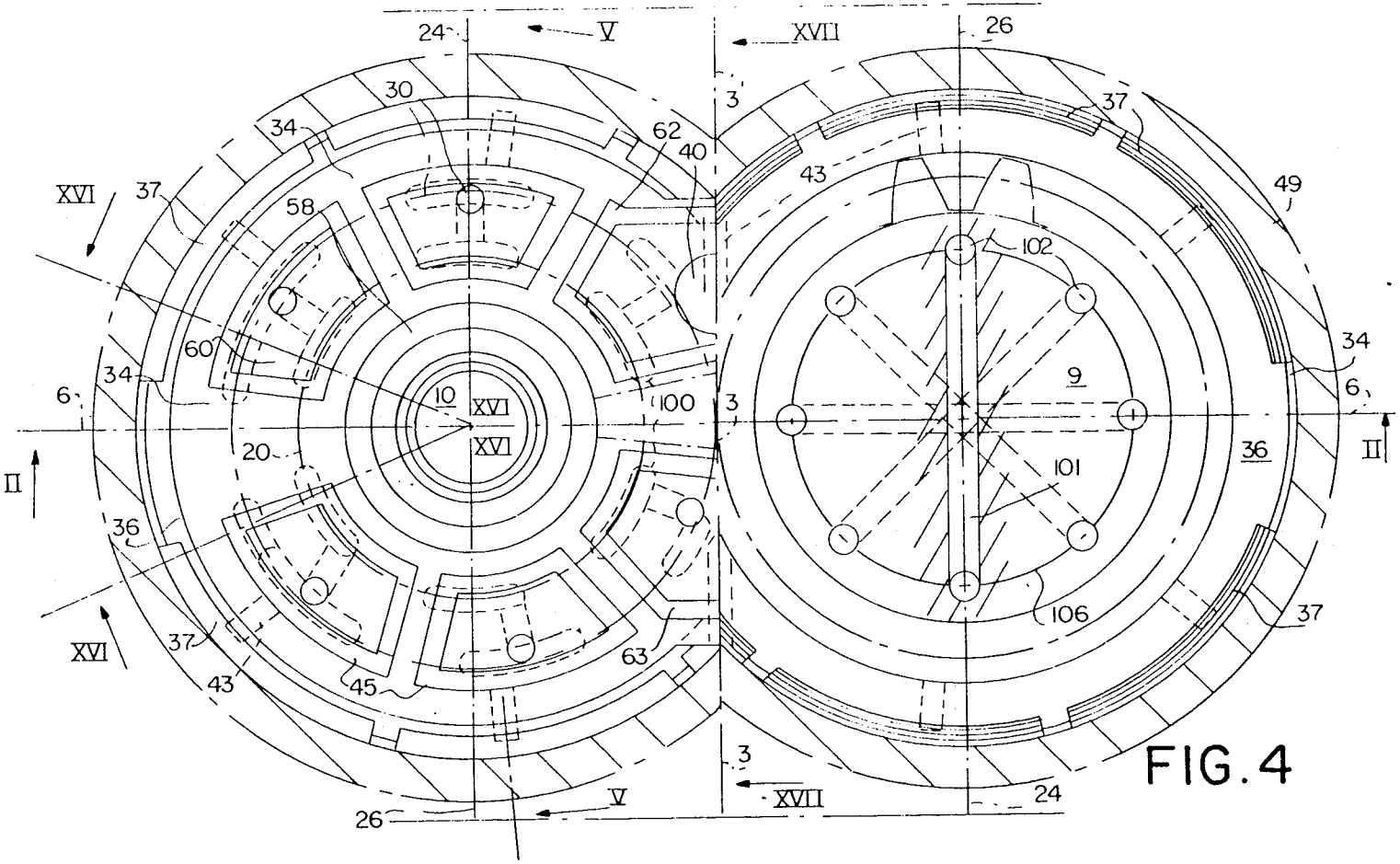
FIG. 4 is a view similar to the one of FIG. 3 but illustrating an alternative according to which the hydrostatic compensation sectors are not symmetrical with respect to the axis of said hydraulic bearings.

FIG. 4, which shows partial cross-sections along the line III—III (FIGS. 2 and 20), illustrates the layout of the hydrostatic compensation sectors 60 on plates 21 and 22 in the case of an asymmetrical construction. This layout corresponds exactly to the pressure to be equilibrated since it takes into account the offset resulting from the helix angle $\alpha$, i.e., a half angular tooth pitch $\pi/Z$. Therefore, though the plates 21 and 22 are still identical, when they are positioned inside the generator-receiver, they display only a central symmetry with respect to point 3 where the gears 9 and 10 engage each other at mid-height of the teeth This figure also illustrates a possibility of balancing by a channel 103, as well as another embodiment of the gears 9 and 10, in two separate parts assembled by brazing or sintering.

It should be noted that the FIGS. 3 and 4 represent the hydrostatic compensation sectors on the plates 21 and 22 located near point 3, reduced by a certain amount to allow for the zone 34 at point 3 (basically 1 angular tooth pitch when the number of teeth Z is an odd number). When Z is even, the sectors in the region of point 3 have a normal value if zone 34 at 3 is equal to zone 34 at 6, i.e., one angular tooth pitch $2\pi/Z$, and they are larger when the zone 34 defined for point 3 is smaller.

Figure 5:
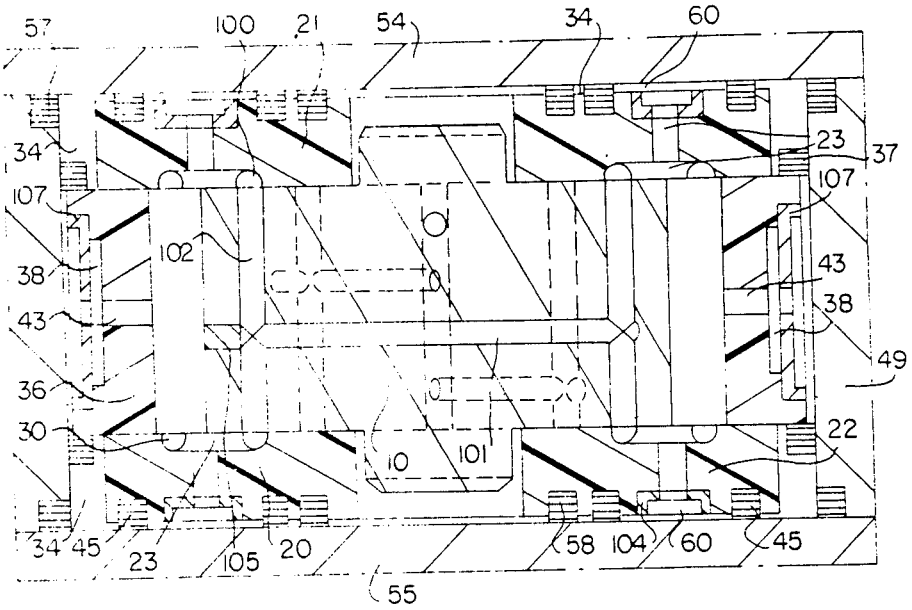
FIG. 5 is a cross section along line V—V (FIGS. 3 and 4)

FIG. 5, a cross-section along the line V—V (FIGS. 3 and 4), represents the channels 101 and 102 through the gears 9 and 10 which are closed off by the plug 105. This figure illustrates the different examples of embodiments:

Plate 21 is made of a rigid material, therefore obviating the anti-extrusion device 104. The seals 45 and 58 are housed in the cover plate 54.

Plate 22 is made of plastic material, comprising an anti-extrusion device. The housings of the seals 45 and 58 are molded in the plate 22.

Figure 6:
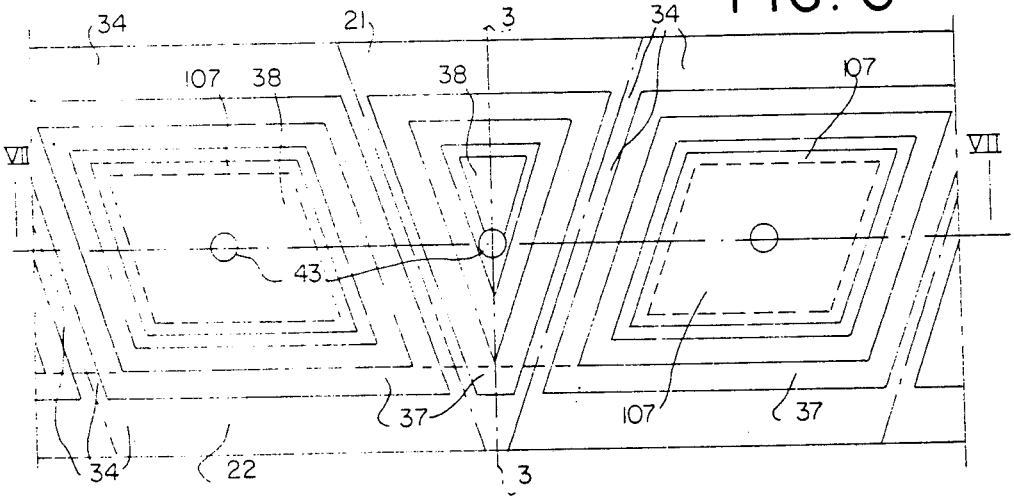
FIG. 6 is an enlarged detailed outside view of the envelope which surrounds the gears.

The casing 36 is made of plastic material, the hydrostatic compensation sectors on the casing 36 consist of the recess 38, the seal 37, the feeding orifice 43 and the anti-extrusion device 107 shown in FIG. 6. The balancing between two opposed tooth grooves is clearly shown by the cavities 30, the channels 23, the stator cavities 100 and the rotor channels 101 and 102.

FIG. 6 is an enlarged detailed exterior view of the casing 36, and shows the hydrostatic compensation sectors 38 on the casing 36 and their feeding orifice 43. On the axis 3 corresponding to the meshing point of the gears 9 and 10, the no-return feeding valve 39 of the zone 34 has been replaced by an orifice 43, the zone 34 at point 3 being replaced at this point by the hydrostatic compensation sector, because it is essential to have the same pressure at the axis 3 inside and outside the casing. The role of the no-return feeding valve 39 of the zone 34 is performed by a priority valve device.

Figure 7:
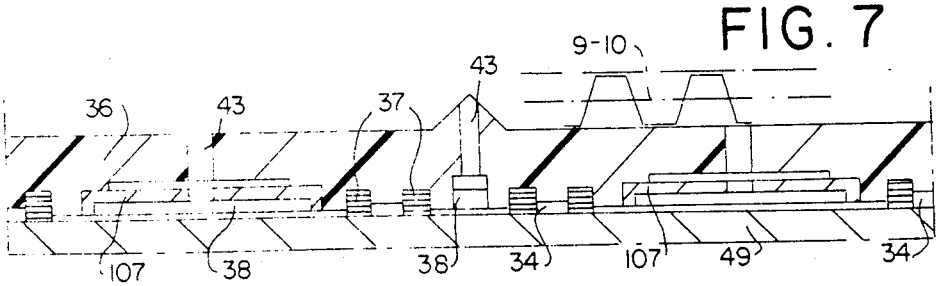
FIG. 7 is a cross section along VII—VII (FIG. 6)

FIG. 7 is a cross-section along the line VII—VII (FIG. 6) through the casing 36 and represents the hydrostatic compensation sectors 38 on the casing 36 with an anti-extrusion device 107 and feeding orifice 43.

Figure 8:
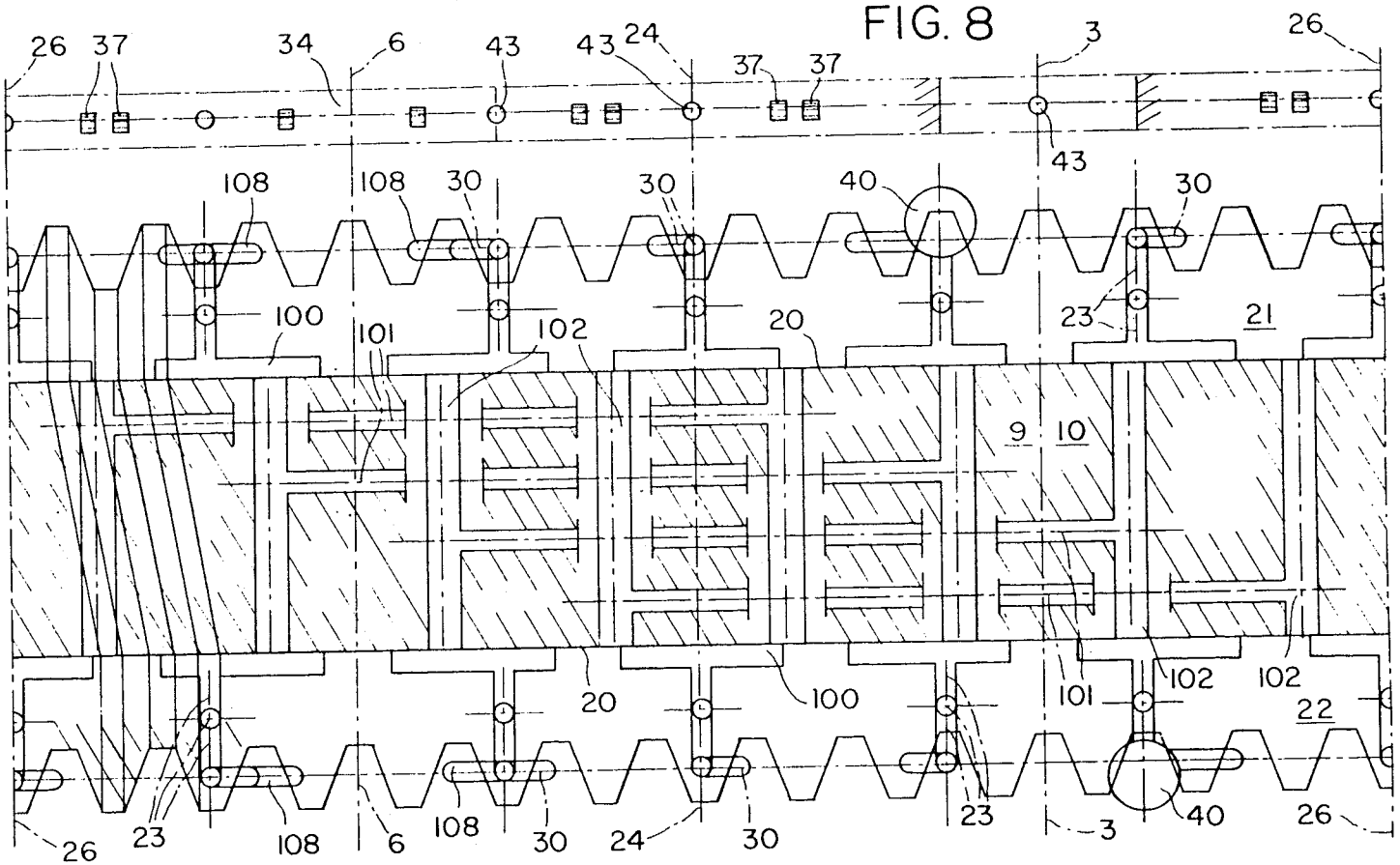
FIG. 8 is an overall view showing the channels into the rotor and the stator, respectively, for an even number of teeth, and of symmetrical construction of the hydrostatic compensation sectors on the plates.

FIG. 8 is an overall view of the stator circuits composed of the cavities 30, channels 23, cavities 100, and of the rotor circuits composed of the channels 101 and 102 in the case of an even number of teeth Z and of symmetrical construction of the hydrostatic compensation sectors 60 on the plates 21 and 22. The upper drawing shows the layout of the envelope 36 with the zone 34, the seals 37 and the orifices 43. A recess 108 extends the cavities 30 towards point 6 in order to achieve hydrostatic equilibrium between the tooth grooves in 6 and the formation of hydraulic bearings, thus replacing orifice 33 of U.S. Pat. No. 4,781,552. This layout provides for better control of the hydrostatic equilibrium in 6 depending on the priority operation mode, generator or receiver, by adjusting the length of the recess 108.

Figure 9:
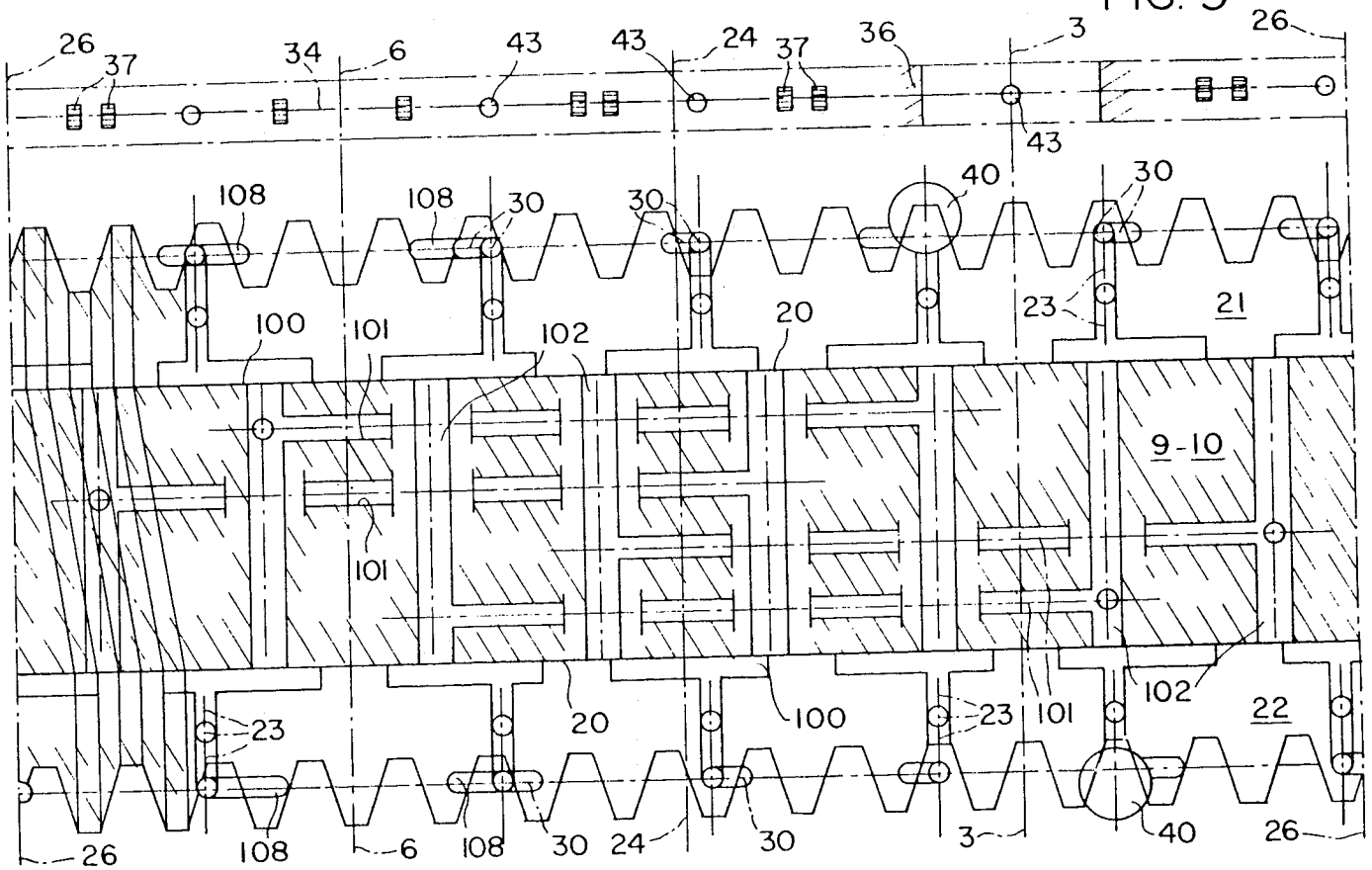
FIG. 9 is a view similar to FIG. 8 illustrating the channels in case of an odd number of teeth and of symmetrical construction of the hydrostatic compensation sectors on the plates.

FIG. 9 is an overall view of the stator and rotor circuits in case of an odd number of teeth Z and of symmetrical construction of the hydrostatic compensation sectors 60 on plates 21 and 22.

Figure 10:
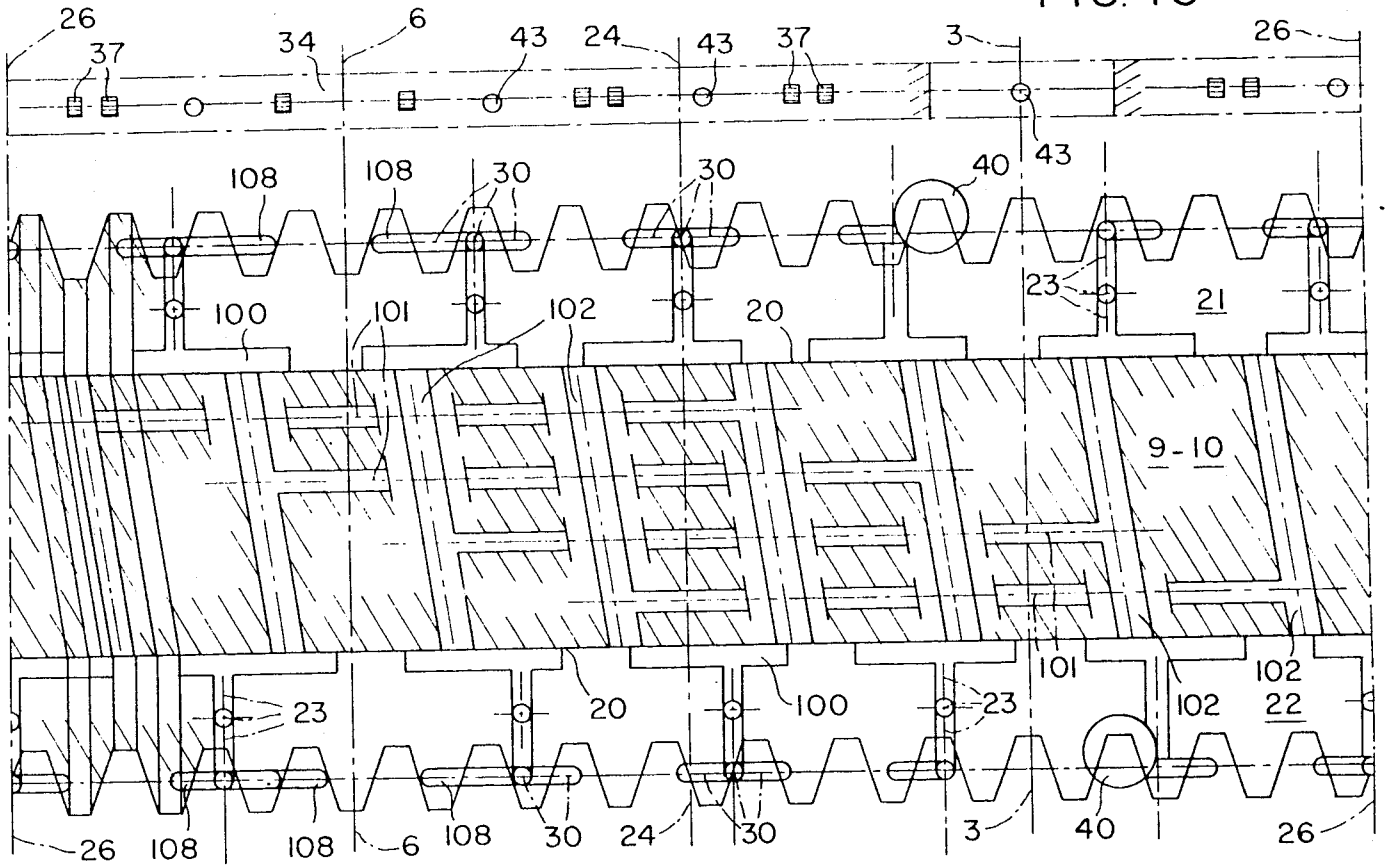
FIG. 10 is a view similar to FIG. 9 in the case of an asymmetrical construction of the hydrostatic compensation sections.

FIG. 10 is an overall view of the stator and rotor circuits in the presence of an odd number of teeth Z and of an asymmetrical construction of the hydrostatic compensation sectors 60 on the plates 21 and 22. It requires an offset of a half angular tooth pitch $\pi/2$ of the cavities 100 and the channels 102 to be at an angle equal to the helix angle $\alpha$. This provides for a more constant equilibrium between the tooth grooves, while the cavities 100 may be at a larger angle.

Figure 11:
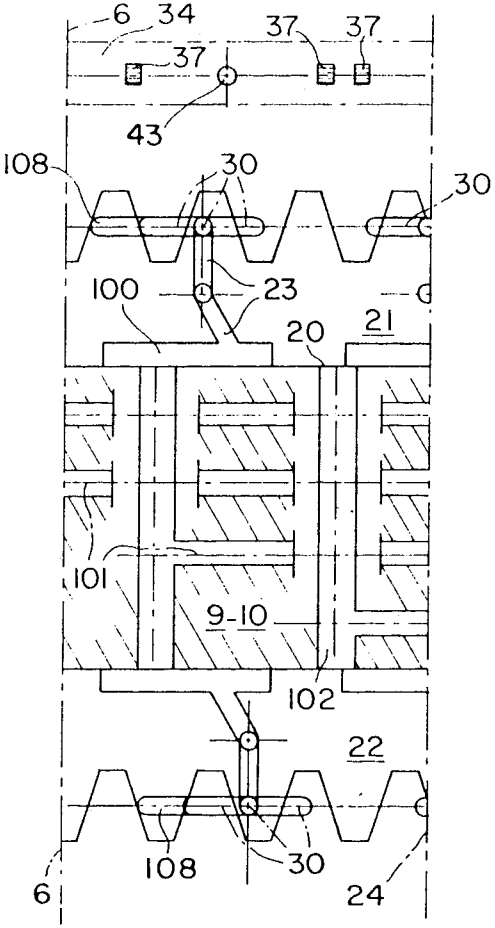
FIG. 11 is a fragmentary view of FIG. 10 illustrating an alternative stator channel.

FIG. 11 is an overall view of the rotor and stator circuits for an odd number of teeth Z and an asymmetrical construction of the hydrostatic compensation sectors 60 on plates 21 and 22. This type of construction eliminates the necessity of offsetting the cavities 100 of the plates 21 and 22 by a half angular tooth pitch, and of keeping the channels 101 and 102 parallel to the axis of the gears 9 and 10. The offset of $\pi/2$ is thus achieved by giving a spiral shape along a quarter of angular tooth pitch to the channels connecting the cavities 30 to the cavities 100. Alternative layouts may be devised in order to facilitate manufacturing.

FIGS. 12, 13, 14, and 15 are cross-sections along the line II—II of FIGS. 3 and 4, and illustrate different types of play compensating devices made of the plates 21 and 22 and casing 36.

The compensation of play on the heads and faces of the teeth of the gears 9 and 10, i.e., along two concurrent directions, requires a certain plasticity of the material along at least one of these directions to allow for play compensation in the other direction. This means that a choice must be made between three possible options as regards the selection of the materials to be used:

rigid and non-deformable casing 36, with plates 21 and 22 in plastic;

casing 36 in plastic, with rigid and non-deformable plates 21 and 22;

casing 36 and plates 21 and 22 all in plastic.

Figure 12:
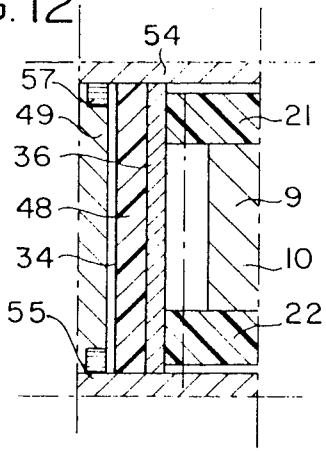

The housings for the seals of the hydrostatic compensation sectors preferably being molded, the following types of construction can be considered:

FIG. 12, shows deformable plates 21 and 22 and rigid casing 36 with plastic lining. The housings of the seals are molded either in the covers 54 and 55 or in the plates 21 and 22, and in the plastic lining 48 or in the body 49.

Figure 13:
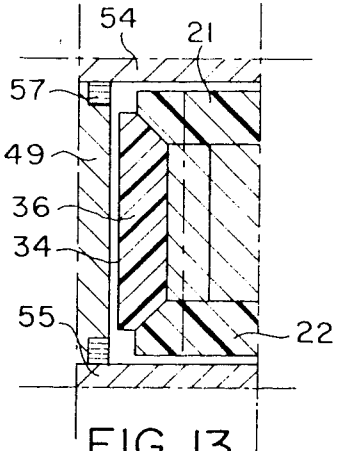

FIG. 13, shows plastic plates 21 and 22 and rigid or plastic casing 36. The housings of the seals are molded either in the covers 54 and 55 or in the plates 21 and 22, and in the body 49 or in the casing 36. It should be noted from FIG. 13 that the contact surface between the casing 36 and the plates 21 and 22 is at a 45° angle, which provides for a better tightness between the faces in contact, on account of the pressures of zone 34 applying on them in order to ensure a playless contact, in particular for the low pressure sectors.

Figure 14:
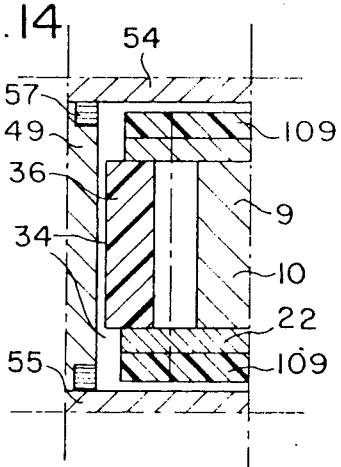
FIGS. 12 to 15 are fragmentary cross sections illustrating alternatives to FIG. 5 concerning the construction of the envelope and the plates.

FIG. 14, shows rigid plates 21 and 22 with plastic lining 109, and plastic casing 36. The housings of the seals molded in the covers 54 and 55 or in the plastic lining 109, and in the body 49 or in the casing 36.

Figure 15:
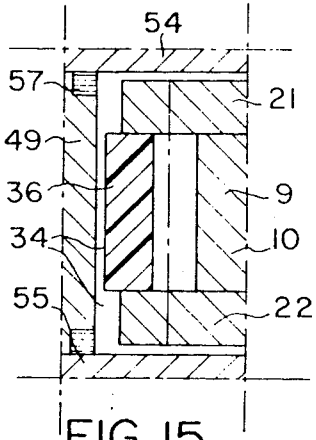

FIG. 15 shows rigid or plastic plates 21 and 22, and plastic casing 36. The housings of the seals are molded in the covers 54 and 55 or in the plates 21 and 22, and in the body 49 or the casing 36.

Figure 16:
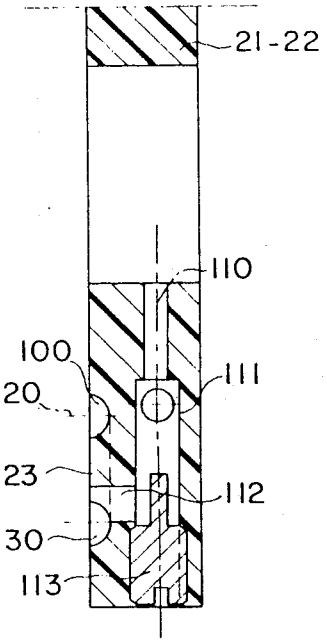
FIG. 16 is a cross section along line XVI—XVI of FIGS. 3 and 4.

FIG. 16, which is a cross-section along line XVI—XVI in FIGS. 3 and 4 illustrates the leak return line towards the low pressure sector, running from the boring of the plates 21 and 22 through a channel 110 equipped with a non-return valve 111 and further through the channel 112 into an LP-HP hydrostatic compensation sector 60, the unit being closed off by a plug 113.

Each plate 21 and 22 is equipped with four non-return valves for all operation modes, rotation directions, generator or receiver mode, i.e., two devices for each boring. These devices can be considerably simplified, in particular in the case of plastic plates 21 and 22, the non-return valve 111 being possibly made of a metallic washer located at the inlet of the evacuation channel in the hydrostatic compensation sector 60.

Figure 17:
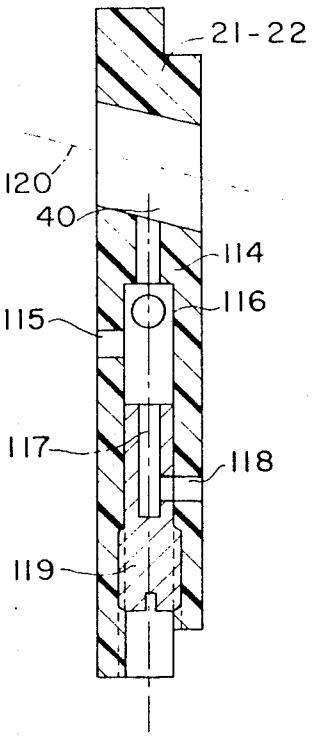
FIG. 17 is a cross section along line XVII—XVII of FIGS. 3 and 4.

FIG. 17, which is cross-section along line XVII—XVII in FIGS. 3 and 4, illustrates the new pressurization and depressurization device of the zone 34, replacing the non-return valve 39 at point 3 and the orifice 33, described in U.S. Pat. No. 4,781,552 at point 6, which have been omitted (with respect to U.S. Pat. No.

4,781,552) the zone 34 being the permanent total pressure zone generated. The feeding and depressurization of the zone 34 occurs either through channel 114, or through the channels 117 and 118, the selection being performed by the priority valve 116 ending into channel 115 that leads to the zone 34. This assembly is closed off by the plug 119. This figure shows the HP-LP orifice 40 at an angle equal to the helix angle $\alpha=2H/\pi Mt$, 120, where Mt is the apparent diametral pitch and H the tooth width 4. The angle $\alpha$, 120, can take on values approximately equal to 45° in units with a high rotation speed, in particular when using V-toothed gears. If high pressure comes from orifice 40, it pushes the ball 116 against the origin of channel 117 so that the pressure passes to zone 34 through channel 115. If high pressure comes from channel 118 (from the second orifice 40, the one illustrated in FIG. 17 being under low pressure), the ball is pushed against the channel 114 so that once more, the high pressure passes to zone 34 through channel 115. Under these circumstances, the HP-LP channels are arranged perpendicularly to the axes of the gears and positioned at the same places as on generators and receivers with straight toothed gears.

Figure 18:
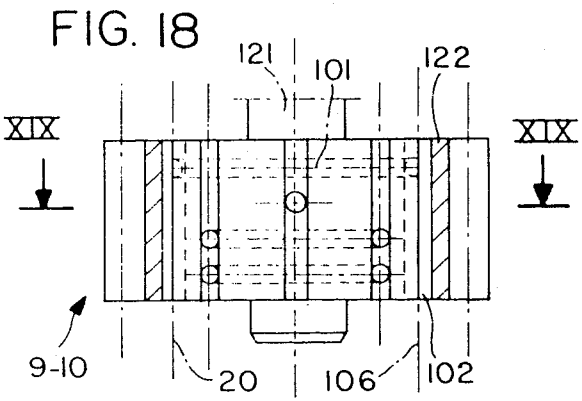
FIG. 18 is a cross section along line XVIII—XVIII of FIG. 19.
Figure 19:
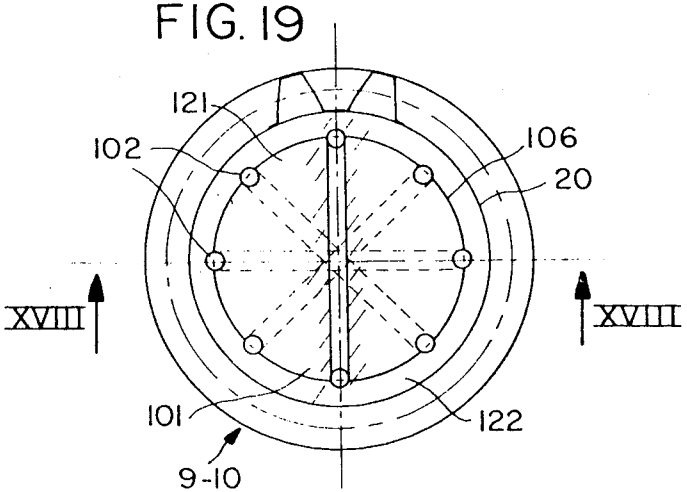
FIG. 19 is a cross section along line XIX—XIX of FIG. 18.

FIG. 18, which is a partial cross-section along the line II—II of FIGS. 3 and 4 and FIG. 19, which is a partial cross-section through the channel 101, show manufacturing examples of gears 9 and 10 in two separate parts:

- a central core 121 with half channels 102 on the commutation circle 20 and the channel 101 bored through this core;
- a toothed crown 122 with the other parts of the channels 102 on the commutation circle 20. This crown is either manufactured and assembled by brazing 106 on the core 121, or sintered and anchored on the core 121 along the commutation circle 20.

Figure 20:
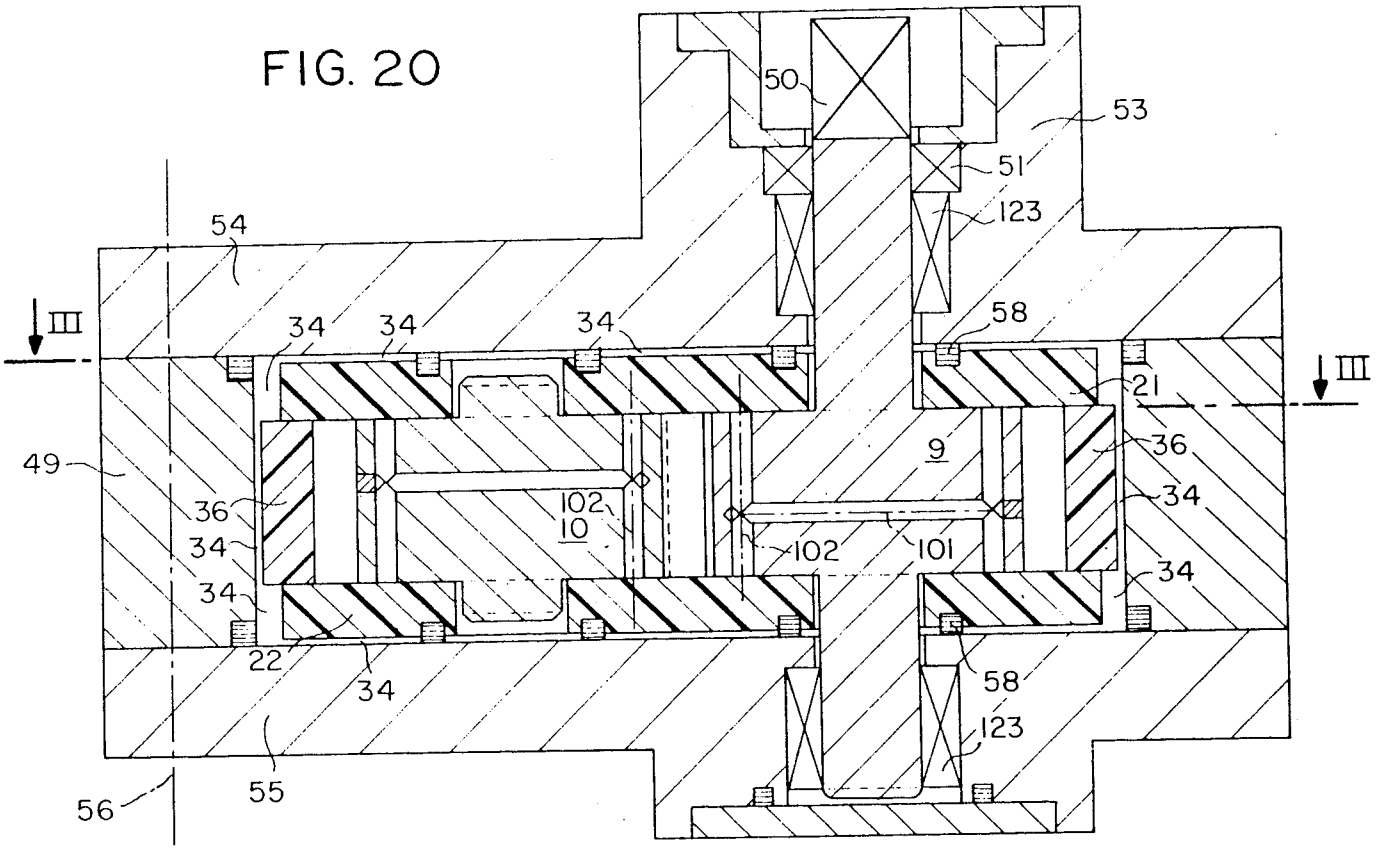
FIG. 20 is a view similar to FIG. 2 but illustrating an alternative. On this Figure is shown the cross sectional plane III—III of FIGS. 3 and 4.

FIG. 20, which is a cross-section along the line II—II of FIGS. 3 and 4, is another way of protecting the drive gear 9 from external stresses transmitted through the power shaft: shocks, unwanted stresses or internal stresses resulting from possible balancing failure of the hydrostatic compensation. In the area of the covers 54 and 55, the gear 9 is maintained by two needle bearings 123 that hold it in position with respect to the body 49 and the covers. The other parts which form the core of the generator/receiver, i.e., gear 10, plates 21 and 22, and casing 36, equilibrate each other around the position of gear 9 in the same way as in the other arrangements. This layout is an alternative version of the shaft 52 protecting the gear 9. In association with the hydrostatic compensation devices, it also provides for the correction of certain minor balancing failures during operation and of other balancing failures resulting from the compressibility of the hydraulic fluid in cases where the number of teeth Z is an odd number.

GENERAL CONSTRUCTION RULES

The object of the theoretical study to be performed is to determine the maximum operating pressure, the number of teeth Z, the tooth width H, 4, the apparent diametral pitch Mt, 5, or the real diametral pitch Mn, the helix angle $\alpha$, the diameter d of the output shaft, the number of sectors 2N, the number D of channels through the gears 9 and 10 along the width H of the toothing 4, according to the characteristics of the generator-receiver unit: power, torque, maximum rotation speed W, maximum velocity V in meters/second admissible for the hydraulic fluid, the priority rotation direction either as a generator or a receiver, the efficiency, the cost and so on . . .

On the one hand, a small generator/receiver unit with a priority mode as generator and a high rotation speed of about 3000 to 4000 rpm should have a small number of sectors N, say N=2, a small number D of channels, say D=3 or 4, and a small width H of the toothing 4, or a V-toothing, in order to limit the maximum fluid velocity during operation at maximum rotation speed.

On the other hand, a large generator/receiver unit operating at low rotation speed, say 100, 200 or 300 rpm, with a priority mode as receiver, should have a large number N of sectors, say N=4, 5, 6 . . . , a high number D of channels, say D=5, 6, 7 . . . and a large width H of toothing 4 in relation to the hydraulic fluid velocity.

DETERMINATION OF THE OPERATING PRESSURE

The operating pressure increases with the power to be transmitted. It should be as high as possible while remaining compatible with low output values and with the dimension requirements for the sectors N, and also, for higher output values, with the maximum mechanical stresses admissible for the gears, which are usually three or four times the value of the hydraulic pressure. These pressure values can vary from 100 to 800 bars.

DETERMINATION OF THE NUMBER OF TEETH

Z is an odd number, say Z=9, 11, 13, 15, 17, 19, 21 . . .

High rotation speeds w: Z should be as small as possible, possibly with V-toothed gears for the very high speeds.

Low rotation speeds w: Z increases, and the rate of increase depends partially on the mechanical characteristics of the envelope 36. For a given unit, efficiency and cost increase with Z. The number of teeth Z depends on the tooth width H, in relation to the maximum rotation speed w and to the maximum velocity of the hydraulic fluid expressed in meters by second.

DETERMINATION OF THE TOOTH WIDTH H,4

If V is the maximum velocity of the fluid in meters/-second, w the maximum rotation speed in rpm, H is given by the equation $H=(V\times 60)/(w\times Z)$. The hydraulic fluid flow velocity is the axial component of the displacement velocity in the tooth grooves: this component is the only one to be considered since the tangential component is cancelled by the rotation speed of the gear. All this works just as if generating or receiving were achieved by a piston-tooth moving at a constant speed inside a hollow cylinder, this speed being Z times the tooth width H during a period corresponding to one revolution of the gear, in the axial direction.

DETERMINATION OF THE APPARENT DIAMETRAL PITCH Mt, 5

Calculation of the power transmission Mt as a function of the selected pressure, the rotation speed w, the number of teeth Z and the tooth width H, 4.

DETERMINATION OF THE HELIX ANGLE

The value of $\alpha$ is given by the equation $Tg\ \alpha=2H/(\pi Mt)$.

DETERMINATION OF THE OUTPUT SHAFT DIAMETER d d is calculated as a function of the maximum torque to be transmitted and of the maximum admissible stress.

DETERMINATION OF THE NUMBER OF SECTORS 2N

The angular value of the sectors is given by:

If Z is even: $\text{sector} = [(360° \times (Z-2)]/Z \times 2N$

The bearing in 3 with a value of one angular tooth pitch, zone 34, is distinct from the sectors located near point 3.

If Z is odd: $\text{sector} = [(360° \times (Z-1)]/Z \times 2N$

The bearing in 3 with a value of one angular tooth pitch, zone 34, shortens the sectors located on each side of the point 3 by one half angular tooth pitch.

Therefore, the sectors N on each side of the zone 34 in 3 have the following values:

Reduced by one half of the zone 34 if Z is odd;

Normal if Z is even.

The selection of a symmetric layout of the hydrostatic compensation sectors on the plates 21 and 22 relative to the median plane perpendicular to the axes of the gears 9 and 10, at half their height, or of an asymmetric arrangement, i.e., with an offset of one half angular tooth pitch for better pressure equilibrium, depends on the materials used, but the second solution should be satisfactory under any conditions.

The following table gives the possible options for the sectors: the values underlined by a continuous line are those which give the same pressure inside and outside the casing 36 along the axis 3: the values underlined by a dotted line are those leading to possible designs for receivers, but with a lower pressure outside the casing 36 than inside along the axis 3.

The number of sectors 2N is to be determined as a function of the requirements; efficiency and cost increase with N; the more the output per revolution increases, the more Z and N increase in order to solve the problems of resistance and dimensions of the casing 36. However, the theoretical study should always strive to maintain Z and N as low as possible.

MANUFACTURING THE COMPONENTS

| | |
|---|---|
| Body 49 | Made by molding of aluminum alloy, cast iron or steel |
| Covers 54 and 55 | Made by molding of aluminum alloy, cast iron or steel |
| Plates 21 and 22 | Plastic or composite materials: molding |
| | Hard materials: aluminum/lead alloy with good friction characteristics |
| | Hard materials: with plastic lining 109, molding |
| Casing 36 | Plastic or composite materials: molding |
| | Hard materials: nitrided steel |
| | Hard materials with bonded plastic lining: molding of the sealing plug housings |
| Gears 9 and 10 | Hard materials: cemented or nitrided steel |
| | Manufacturing: |
| | Complete machining in one part, or in two parts assembled by brazing |
| | Sintering of a toothed crown on a previously machined core |
| | Sintering of the unit as a whole |

| | Balancing sectors in function of the number of teeth Z | | | | | |
|---|---|---|---|---|---|---|
| Number of teeth Z | Number of sectors 2N | Angular value of sectors 2N = 4 | 2N = 6 | 2N = 8 | 2N = 10 | Angular value 2 pitches |
| | | | Z = odd number | | | |
| Z = 9 | 4 | 80° | 53°33 | | | 80° |
| Z = 11 | 4-6 | 81°82 | 54°54 | | | 65°45 |
| Z = 13 | 4-6 | 83° | 55°40 | 41°53 | | 55°38 |
| Z = 15 | 4-6-8 | 84° | 56° | 42° | | 48° |
| Z = 17 | 4-6-8 | 84°70 | 56°47 | 42°35 | 33°88 | 42°35 |
| Z = 19 | 4-6-8-10 | 85°275 | 56°85 | 42°64 | 34°11 | 37°90 |
| Z = 21 | 4-6-8-10 | 85°72 | 57°14 | 42°86 | 34°29 | 34°29 |
| | | | Z = even number | | | |
| Z = 14 | 4-6 | 77°14 | 51°43 | 38°57 | | 51°43 |
| Z = 16 | 4-6-8 | 78°75 | 52°50 | 39°375 | | 45° |

I claim:

1. A reversible generator-receiver comprising an assembly of:

(a) a plurality of free-floating interengaging helicoidal gear means (9, 10) at a mesh point, said gear means having teeth constituting spaces between said teeth and two sides and being mounted without mechanical bearing means;

(b) a flexible enclosure (36) surrounding said gear means (9, 10);

(c) a plurality of side plates (21, 22) in abutment against the sides of said gear means (9, 10);

(d) a rigid shell (49, 54, 55) enclosing (a), (b) and (c);

(e) hydraulic sectors (38) for pressurizing the periphery of said flexible enclosure (36) so as to force the latter against crests of said teeth so as to render said tooth spaces fluid-tight;

(f) opposed hydrostatic compensation sectors (60) for applying equilibrated pressure to said side plates (21, 22) so as to obtain fluid-tightness on both sides of said gear means (9, 10);

(g) a hydraulic winding comprising a plurality of rotor conduits in said free floating gear means (9, 10) and a plurality of stator conduits (23) in said side plates, successive commutations between said plurality of rotor conduits and said stator conduits being provided by ends of said conduits passing one in front of the other along a circle of commutation (20) and simultaneously on said tooth spaces at the level of a rolling pitch circle for another end of said stator conduits to provide permanent connection between said opposed tooth spaces except in zones wherein hydraulic bearings are created, each zone of said hydraulic bearings which is opposite said mesh point being accompanied (i) by a break in the connection between tooth spaces at a given point and a point opposite said given point, and (ii) by conservation of pressure by supplying said hydraulic bearings for creating with high pressure via a conduit member from a zone (34) of permanent total pressure, wherein (h) said rotor circuits into said gears (9, 10) are constituted by groups of first conduits (102) diametrically opposed (102) around said circle of commutation (20) and parallel to an axis of said gear means, and connecting said conduits (102) diametrically opposed at $\pi$;

(i) said rotor circuits supply said stator circuits in said plates (21, 11) and said casing (36) through cavities (100) on said circle of commutation (20) and second conduits (23); and (j) priority valve means (116) are provided for selectively pressurizing and depressurizing said zone (34) of permanent total pressure.

2. Hydraulic generator/receiver according to claim 1, wherein said opposed hydrostatic compensation sectors (60) on said side plates (21) and (22) are arranged symmetrically with respect to a median plane perpendicular to the axis of said gear means (9, 10), whereby the connections between said sectors (60) are obtained by arrangements of said first conduits (102) constituting said rotor circuits, said cavities (100), and said second conduits (23).

3. Hydraulic generator-receiver according to claim 1, wherein said opposed hydrostatic compensation sectors (60) on said plates (21, 22) are offset by a half angular tooth pitch $\pi/2$ so as to correspond to pressures to be balanced, whereby the connections between said sectors (60) are obtained by arrangements of said first conduits (102) constituting said rotor circuits, said cavities (100), and said second conduits (23).

4. Hydraulic generator-receiver according to claim 1, wherein said gear means (9, 10) are manufactured in at least one part and comprise a central core (121) containing radial channels (101) and axial half-channels (102), and a toothed crown (122) brazed or sintered onto said core (121).

5. Hydraulic generator-receiver according to claim 1, wherein said opposed hydrostatic compensation sectors (60) in said side plates (21, 22) and said enclosure (36) are fitted with anti-extrusion drawn metal plates (104, 107).

* * * * *